US012402702B2

(12) United States Patent
Hillebrecht et al.

(10) Patent No.: US 12,402,702 B2
(45) Date of Patent: Sep. 2, 2025

(54) HANDLE FOR HAIR STYLING TOOL WITH REPLACEABLE SPRING

(71) Applicant: Helen of Troy Limited, St. Michael (BB)

(72) Inventors: Luke Hillebrecht, El Paso, TX (US); Gary Koenemann, El Paso, TX (US); William C. Fiebel, Succasunna, NJ (US)

(73) Assignee: KAZ EUROPE SÁRL, Bussigny (CH)

( * ) Notice: Subject to any disclaimer, the term of this patent is extended or adjusted under 35 U.S.C. 154(b) by 411 days.

(21) Appl. No.: 18/077,461

(22) Filed: Dec. 8, 2022

(65) Prior Publication Data

US 2023/0109480 A1 Apr. 6, 2023

Related U.S. Application Data

(63) Continuation of application No. PCT/US2021/038001, filed on Jun. 18, 2021.

(60) Provisional application No. 63/211,159, filed on Jun. 16, 2021, provisional application No. 63/046,755, filed on Jul. 1, 2020.

(51) Int. Cl.
*A45D 1/00* (2006.01)

(52) U.S. Cl.
CPC ..... *A45D 1/00* (2013.01)

(58) Field of Classification Search
CPC ... A45D 1/00; A45D 1/04; A45D 1/06; A45D 1/08; A45D 1/10; A45D 1/14; A45D 1/16; A45D 2001/002
See application file for complete search history.

(56) References Cited

U.S. PATENT DOCUMENTS

| | | | | |
|---|---|---|---|---|
| 9,232,839 | B2 * | 1/2016 | Hein | A45D 1/28 |
| 2001/0035079 | A1 | 11/2001 | Kesinger et al. | |
| 2011/0180096 | A1 | 7/2011 | Palermo et al. | |
| 2013/0125909 | A1 | 5/2013 | Meeks | |
| 2016/0374445 | A1 | 12/2016 | Cho | |

FOREIGN PATENT DOCUMENTS

| | | |
|---|---|---|
| KR | 1020160074948 | 6/2016 |
| KR | 10-1714470 | 3/2017 |
| KR | 1020190079779 | 7/2019 |

OTHER PUBLICATIONS

CN Office action & Search Report filed in CN 202180035352.9 dated Mar. 27, 2024.

(Continued)

*Primary Examiner* — Rachel R Steitz
(74) *Attorney, Agent, or Firm* — RANKIN, HILL & CLARK LLP

(57) ABSTRACT

A hair styling tool or curling iron includes a handle portion and a styling portion. The handle portion houses a torsion spring. The styling portion includes a hair engaging member adapted to be biased toward the styling portion by the torsion spring. A spring door is releasably and/or removably connected to the handle portion and is configured to cover and at least partially secure the torsion spring within the handle portion. The torsion spring is not mechanically connected to the handle portion so that releasing and/or removing of the spring door from the handle portion allows for removal and replacement of the torsion spring.

21 Claims, 7 Drawing Sheets

(56) References Cited

OTHER PUBLICATIONS

International Search Report filed in PCT/US2021/038001 mailed Oct. 15, 2021.
Tt_zone. 'Let's repair a broken spring of the yes-beauty curling iron YB-377 35mm'. Jul. 3, 2019 [retrieved on Sep. 14, 2021]. Retrieved from the Internet: <URL: https://blog.naver.com/tt_zone/221577104237>.

* cited by examiner

HANDLE FOR HAIR STYLING TOOL WITH REPLACEABLE SPRING

BACKGROUND

There are numerous hair styling tools for heated styling of hair, and one example of such hair styling tools are curling irons. As is well known, curling irons impart a curl or pattern to hair being styled by sufficiently heating a barrel of a styling portion of the curling iron and restraining the hair in physical contact with the heated barrel via a clamp or plate for a period of time. When the heat styled hair is removed from the heated barrel, the hair retains the shape of the curling iron's barrel. Typically, a torsion spring is provided to pivot the clamp from an open position to a closed position where the clamp is held against the barrel. However, over time and through continued use of the curling iron the torsion spring can break, and replacement of the torsion spring may be difficult. For example, existing curling irons generally require disassembly of the styling portion and/or handle portion to access the torsion spring. This may require removal of pins, fasteners, spacers, and other components of the curling iron, any number of which may be lost or misplaced. Because of this, many users simply discard the old curling iron, opting to purchase a new one.

SUMMARY

According to one embodiment of the present disclosure, a hair styling tool or curling iron comprises a handle portion and a styling portion. The handle portion houses a torsion spring. The styling portion includes a hair engaging member adapted to be biased toward the styling portion by the torsion spring. A spring door is releasably and/or removably connected to the handle portion and is configured to cover and at least partially secure the torsion spring within the handle portion. The torsion spring is not mechanically connected to the handle portion so that releasing and/or removing of the spring door from the handle portion allows for removal and replacement of the torsion spring.

According to another embodiment of the present disclosure, a hair styling tool or curling iron comprises a handle portion and a styling portion. The handle portion houses a barrel adapter. The styling portion is connected to the barrel adapter and includes a flipper pivotally connected to the barrel adapter. A torsion spring for biasing the flipper from an open portion toward a closed position is removably housed in the handle portion. A spring door removably connected to one of the handle portion and the barrel adapter secures the torsion spring in the handle portion. The torsion spring is not mechanically connected to the handle portion so that removal of the spring door from the handle portion allows for unobstructed removal and replacement of the torsion spring.

According to another aspect, the torsion spring is secured within the handle portion by being positioned between first and second spring mounts provided respectfully on the flipper and the spring door, with one leg biased against the barrel adapter and another leg biased against the flipper.

According to another aspect, the spring door includes one end portion fastened to the barrel adapter and an opposite end portion pivotally connected to the barrel adapter.

According to another embodiment of the present disclosure, hair styling tool or curling iron comprises a handle portion and a styling portion. The handle portion houses a torsion spring. The styling portion includes a hair engaging member adapted to be biased toward the styling portion by the torsion spring. A spring door is releasably and/or removably connected to the handle portion. The spring door is configured to cover and at least partially secure the torsion spring within the handle portion. First and second spring mounts secure the torsion spring within the handle portion. The first spring mount is provided on the spring door so that releasing and/or removing of the spring door from the handle portion allows for removal and replacement of the torsion spring.

According to another embodiment of the present disclosure, a method of removing a torsion spring from a hair styling tool or curling iron is provided. The hair styling tool or curling iron includes a handle portion adapted to house the torsion spring, and a styling portion connected to the handle portion and including a hair engaging member adapted to be biased toward the styling portion by the torsion spring. The method comprises providing a spring door on the handle portion for covering and at least partially securing the torsion spring within the handle portion; releasing and/or removing the spring door from the handle portion to provide direct access to the torsion spring; and removing the torsion spring from within the handle portion.

DETAILED DESCRIPTION

Figure 1:
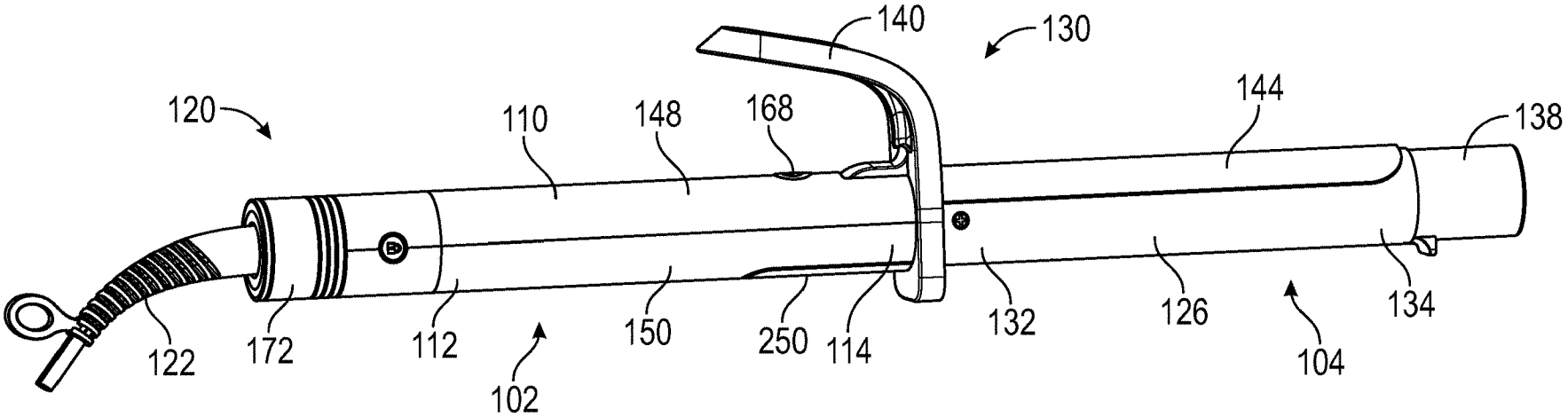
FIG. 1 is a perspective view of an exemplary curling iron according to the present disclosure.

It should, of course, be understood that the description and drawings herein are merely illustrative and that various modifications and changes can be made in the structures disclosed without departing from the present disclosure. Referring now to the drawings, wherein like numerals refer to like parts throughout the several views, FIG. 1 is a perspective view of a hair styling tool 100, for example a curling iron, having a handle portion 102 and a styling portion 104. The handle portion 102 can be defined by a housing 110 having a first or proximal end portion 112 and second or distal end portion 114. A user control part 120 is coupled to the proximal end portion 112, and the styling portion 104 is coupled to the distal end portion 114. A power cord connector 122 for powering the curing iron is coupled to the user control part 120; however, it should be appreciated that the curling iron 100 can be powered by, for example, a battery housed in the handle portion 102. The styling portion 104 includes a barrel 126 and a hair engaging member or flipper 130 operably associated with the barrel. The barrel 126 has a first or proximal end portion 132 axially spaced from the housing 110 by the flipper 130 and a second or distal end portion 134. An insulated tip (i.e., a cool tip) 138 can be connected to the distal end portion 134 of the barrel 126, allowing for ease of handling during use of the curling iron 100. As depicted, the flipper 130 includes a lever 140 connected to a clamp or plate 144, and is movable from an open position to a closed position for positioning hair against the barrel 126. Although, it should be appreciated that alternative configurations of the hair engaging member are contemplated.

Figure 2:
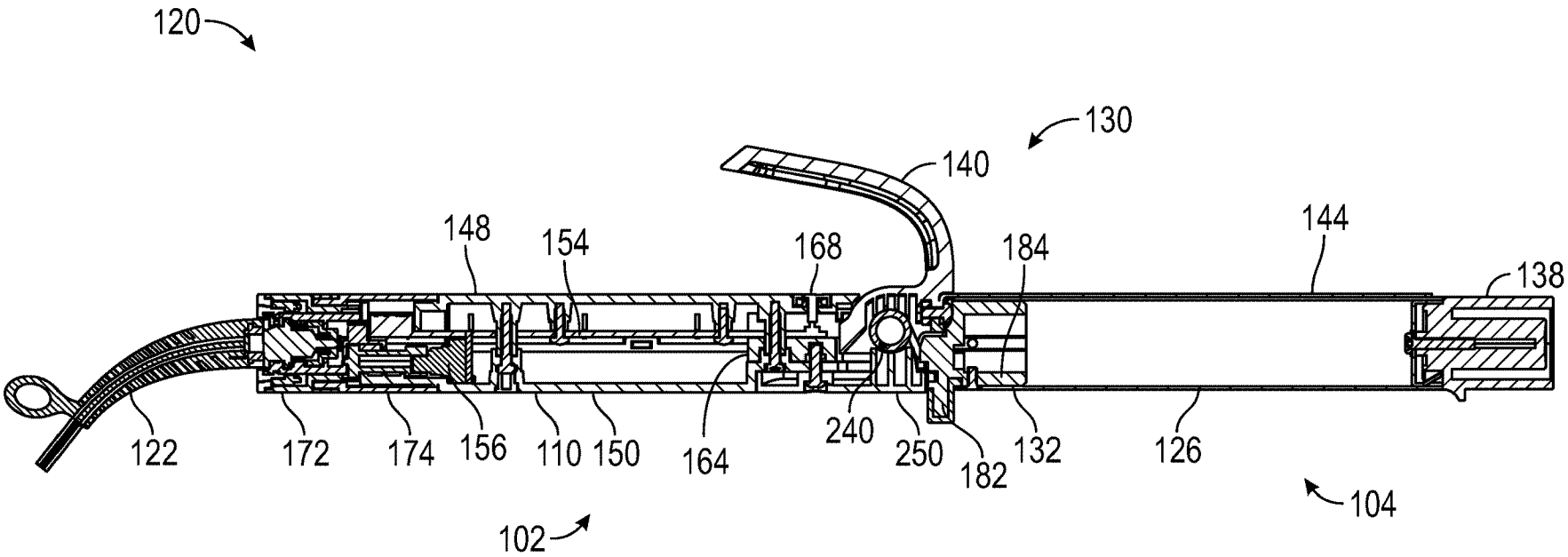
FIG. 2 is a cross-sectional view of the curling iron of FIG. 1.
Figure 3:
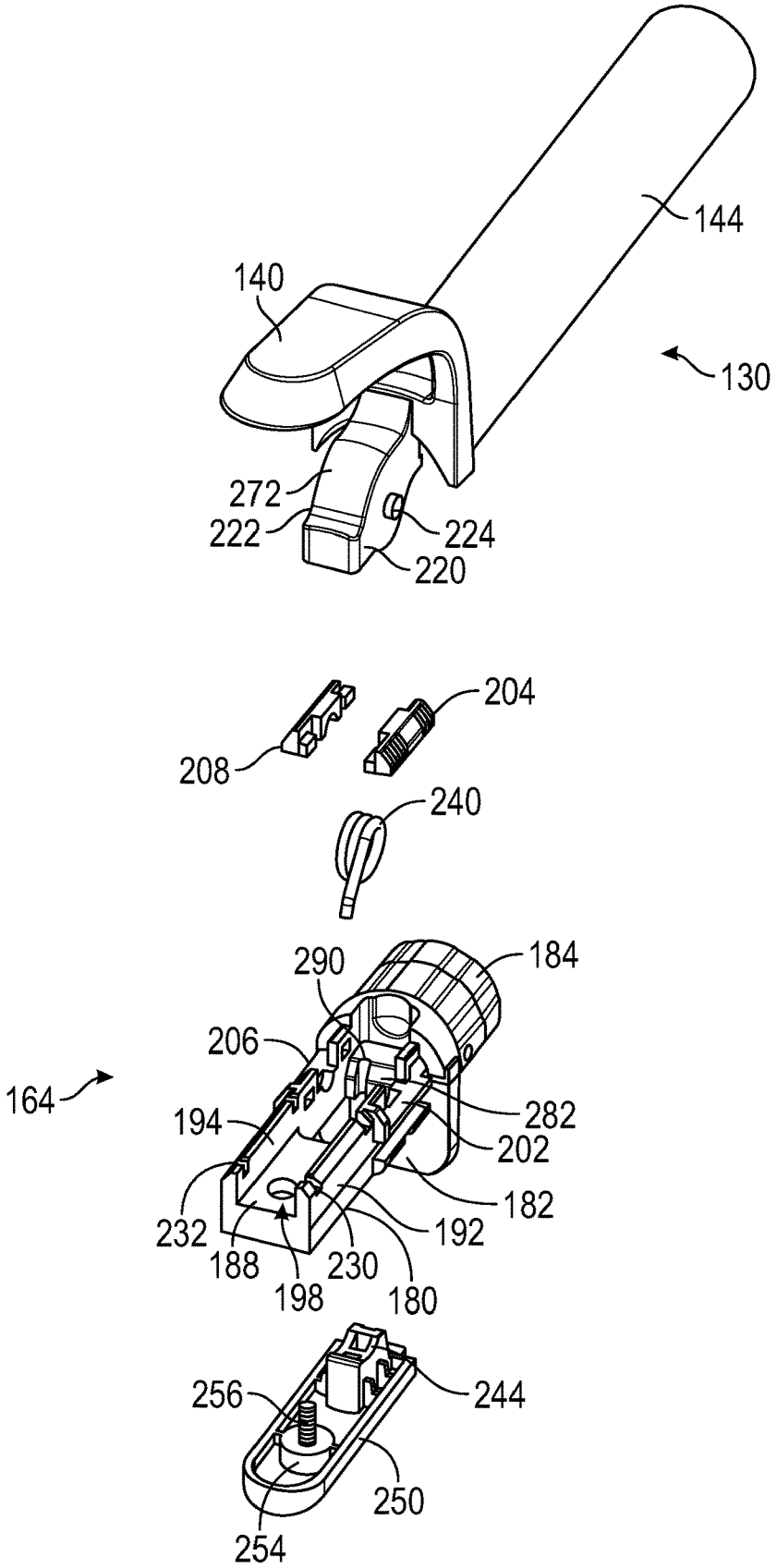
FIG. 3 is a partial exploded perspective view of the curling iron of FIG. 1, showing a flipper connected to a barrel adapter.

The operational components and features of the curling iron 100 will be described with reference to FIG. 2. According to the present disclosure, the housing 110, which can be a two-part housing consisting of an upper or first housing part 148 and a lower or second housing part 150, houses an electronic circuit board (e.g., printed circuit board (PCB) 154) and an encoder 156, which is electrically connected to the PCB. The PCB 154, which can be fastened to one of the first housing part 148 and the second housing part 150, is elongated along a length direction of the housing 110 such that the PCB 154 at least partially extends into the user control part 120 and a barrel adapter 164 located at the distal end portion 114 of the housing 110. A power button 168, preferably located at the distal end portion 114, is electrically connected to the PCB 154. A control knob 172 and a display screen or lens 174 are provided with the user control part 120, each being electrically connected to the PCB 154. The control knob 172 allows a user to select and control one or more of the operable features of the curling iron 100, including a desired output temperature for the styling portion 104. The encoder 156 is operable to detect rotational movement of the control knob 172. The display lens 174 provides a visual indication of the operable features and/or the output temperature. The display lens 174 can be a liquid crystal display (LCD) although other display means, such as light emitting diode (LED) devices, may also be employed and are contemplated herein. The display lens 174 may optionally be equipped with a backlight to illuminate the display lens while the curling iron is switched on. It should also be appreciated that internal electrical connections connect the internal circuitry of the PCB 154 to the power cord connector 122.

The barrel 126 of the styling portion 104 may be made of any thermally conductive material adapted to transfer heat from a heater assembly (not shown) located in the curling iron 100. The barrel 126 may define a smooth cylindrical surface as shown or may have one or more raised or depressed thermally conductive surfaces located thereon including, e.g., transverse ribs, a helical rib, and a raised pattern to impart a decorative crimp or wave pattern onto the hair. The heater assembly may be any conventional heater assembly which can be incorporated within the barrel 126. The PCB 154 may include circuitry to regulate the output temperature of the heater assembly, as selected by the control knob 172.

With reference to FIGS. 3-6, the barrel adapter 164, which secures the styling portion 104 to the handle portion 102, includes a body 180, a curling iron stand 182, and a connecting member 184. The body 180 includes a base wall 188 and first and second side walls 192, 194 extended upward from the base wall 188. With the arrangement of the base and the sidewalls, the body 180 defines a channel 198 elongated along a length direction of the barrel adapter 164. The first sidewall 192 includes a first mounting portion 202 adapted for the mounting of a first bearing cap 204, and the second sidewall 194 includes a second mounting portion 206 adapted for the mounting of a second bearing cap 208. As shown, the first and second mounting portions 202, 206 are located at an end of the body 180 adjacent the stand 182. The first and second mounting portions 202, 206 together with the respective first and second bearing caps 204, 208 rotationally support the flipper 130 on the handle portion 102. By way of example, the first and second mounting portions 202, 206 together with the respective first and second bearing caps 204, 208 can define bosses that receive hubs on first and second flanges 220, 222 depending from the lever 140 (only hub 224 on the first flange 220 is visible). With this arrangement, the flipper 130 is rotationally or pivotally connected to the barrel adapter 164. The stand 182 axially separates the body 180 and the connecting member 184. As depicted in FIG. 1, the stand 182 can be configured to as an extension of the lever 140 to enhance the aesthetics of the curling iron 100. In FIG. 2, the connecting member 184 is received within the first end portion 132 of the barrel 126 and is configured to engage an inner surface of the barrel 126, thereby securely retaining the barrel 126 on the barrel adapter 164. Further depicted in FIGS. 3, 5 and 6, to properly align the barrel adapter 164 within the housing 110, the first and second side walls 192, 194 can include respective notches 230, 232 which receive alignments tabs 234 depending from an inner surface of the upper housing part 148.

Figure 4:
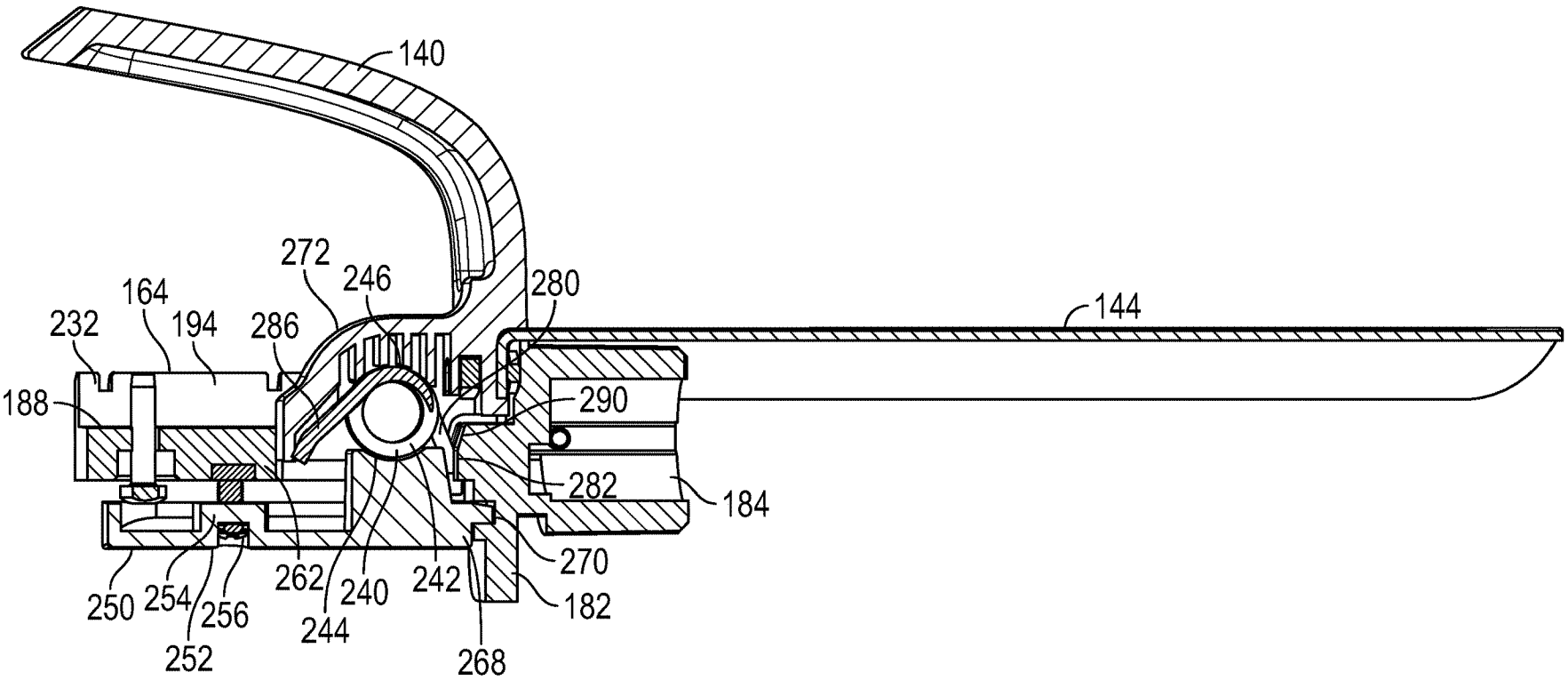
FIG. 4 is a partial enlarged cross-sectional view of the flipper and barrel adapter of the curling iron of FIG. 2.
Figure 5:
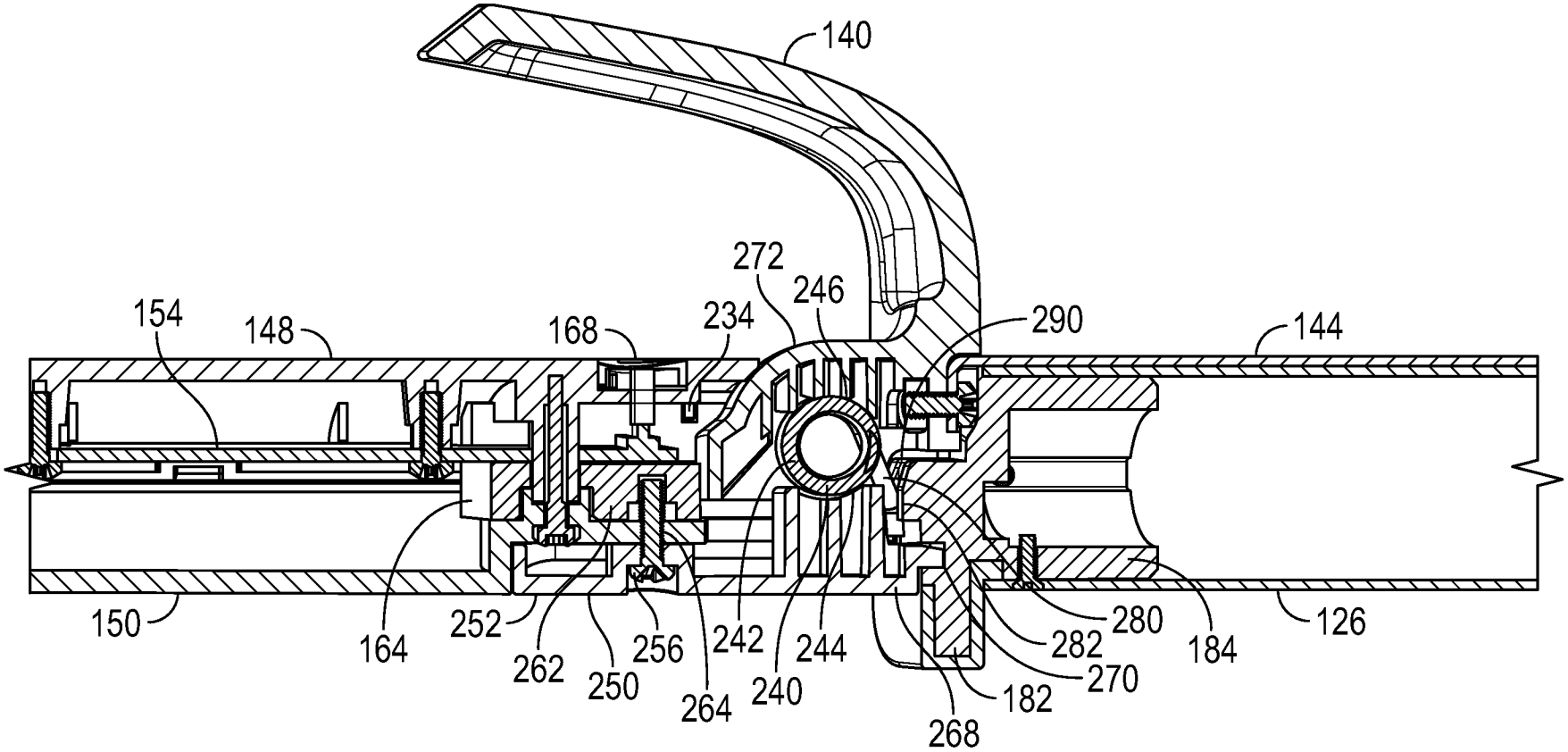
FIGS. 5 and 6 are enlarged partial cross-sectional views of the curling iron of FIG. 1.
Figure 6:
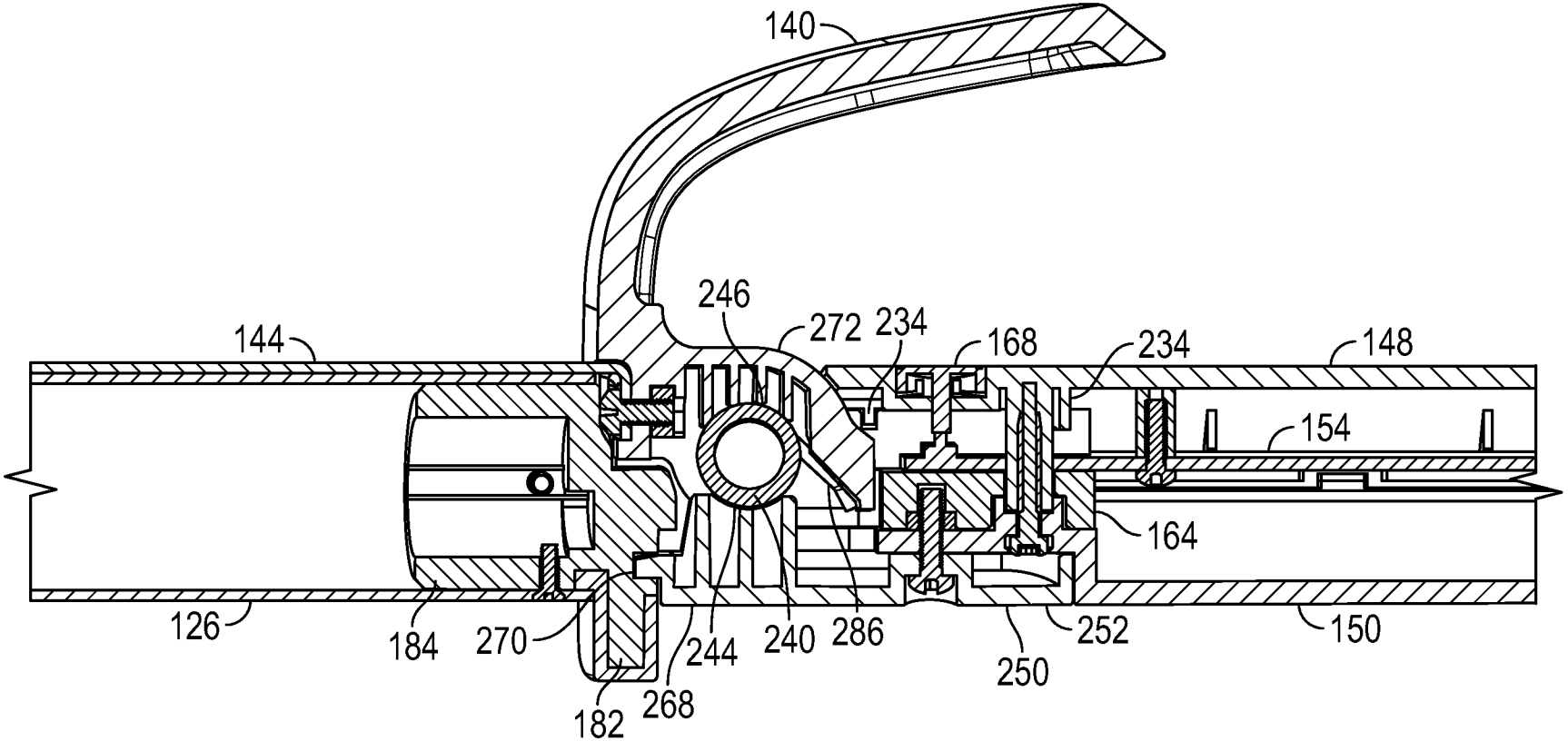

A torsion spring 240 housed in the handle portion 102 is adapted to bias the flipper 130 toward the styling portion 104, and more particularly bias the flipper 130 from an open clamp position toward a closed clamp position where the clamp 144 is held against an outer surface of the barrel 126. In the depicted embodiment, the torsion spring 240 is located at least partially in the channel 198 of the barrel adapter 164 adjacent the stand 182 with a coiled body 242 of the torsion spring seated on/between first and second spring mounts 244, 246. The first spring mount 244 is formed on a spring door 250 that is releasably and/or removably connected or fastened to one of the housing 110 and the barrel adapter 164. As best depicted in FIGS. 4-6, according to one aspect, one end portion 252 of the door 250 includes a mounting boss 254 adapted to receive a fastener 256. The mounting boss 254 is aligned with a corresponding mounting boss 262 depending from the base wall 188 of the body 180 of the barrel adapter 164. The fastener 256 extends through the mounting boss 254, an aperture 264 in the lower housing part 150, and threadingly engages the mounting boss 262. To further secure the door 250 to the barrel adapter 164, an opposite end portion 268 of the door 250 is step-shaped and is received in a cutout or notch 270 located in the stand 182. With the door properly secured to the barrel adapter 164, an outer surface of the door conforms to and is continuous with an outer surface of the housing 110. Further illustrated, the second spring mount 246 for the torsion spring 240 depends the lever 140, particularly from a lever wall 272 that spans between the first and second flanges 220, 222. As shown in FIGS. 4-6, with the torsion spring 240 positioned between the first and second spring mounts 244, 246, one leg 280 of the torsion spring is biased against an inner surface portion 282 of the stand 182, and the other leg 286 of the torsion spring is biased against an inner surface of the lever wall 272. According to the depicted aspect, to maintain contact of the leg 280 with the inner surface portion 282, a notch 290 sized to receive the leg 280 can be formed in the inner surface portion 282. Therefore, in contrast to known designs which mechanically attach a torsion spring to a handle portion (e.g., by a pin extended through the spring), the torsion spring 240 is not mechanically connected to the respective components of the handle portion 102 and the styling portion 104, thereby allowing a user to easily remove and replace a damaged spring simply by releasing and/or removing the spring door 250 from the handle portion 102.

Figure 7:
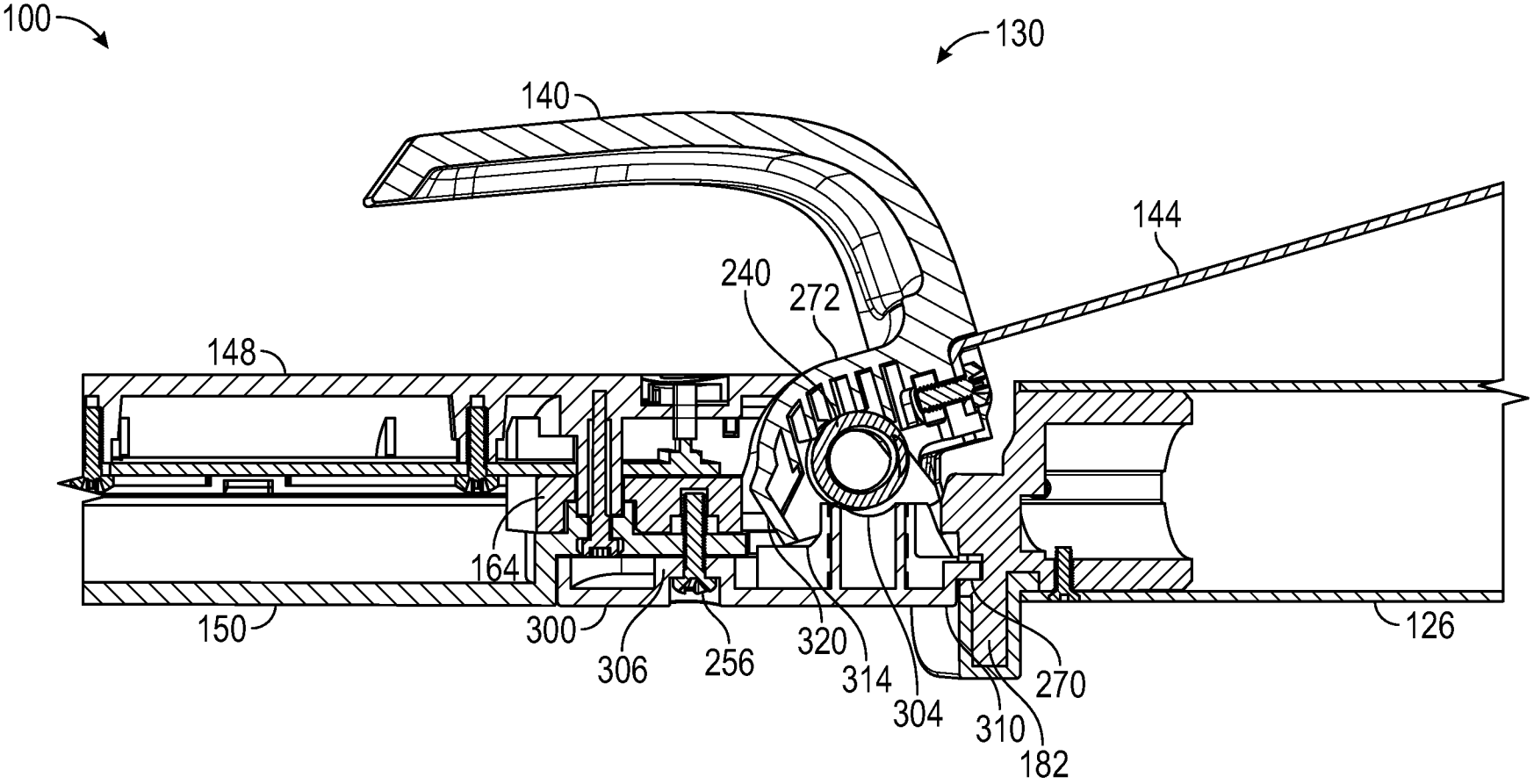
FIG. 7 is an enlarged partial cross-sectional view of the curling iron of FIG. 1 according to another aspect of the present disclosure.

FIG. 7 depicts another configuration of a spring door 300 for use with the curling iron 100. Similar to the spring door 250 described above, the spring door 300 includes a first spring mount 304 for the torsion spring 240 and a mounting boss 306 adapted to receive the fastener 256. An end portion 310 of the spring door 300 is also step-shaped and is received in the cutout or notch 270 located in the stand 182. The spring door 300 further includes a stop 314 located adjacent the first spring mount 304 for the hair engaging member 130. As shown, upon opening of the hair engaging member 130, an end wall 320 depending from the lever wall 272 abuts the stop 314 to define a fully open position of the hair engaging member 130. With use of the stop 314, over-pivoting of the hair engaging member 130 which may damage the torsion spring 240 can be prevented.

Accordingly, the present disclosure provides a hair styling tool or curling iron 100 comprising the handle portion 102 and the styling portion 104. The handle portion 102 houses the torsion spring 240. The styling portion 104 includes the hair engaging member 130 adapted to be biased toward the styling portion 104 by the torsion spring 240. The spring door 250, 300 is releasably and/or removably connected to the handle portion 102 and is configured to cover and at least partially secure the torsion spring 240 within the handle portion 102. The torsion spring 240 is not mechanically connected to the handle portion 102 so that releasing and/or removing of the spring door 250 from the handle portion 102 allows for removal and replacement of the torsion spring 240.

As is evident from the foregoing, a method of removing the torsion spring 240 from the hair styling tool or curling iron 100 is provided. The exemplary method generally comprises providing the spring door 250, 300 on the handle portion 102 for covering and at least partially securing the torsion spring 240 within the handle portion; releasing and/or removing the spring door 250, 300 from the handle portion 102 to provide direct access to the torsion spring 240; and removing the torsion spring 240 from within the handle portion 102. The method includes securing the torsion spring 240 between the first spring mount 244, 304 and the second spring mount 246, with one of the first and second spring mounts provided on the spring door. The method includes housing the barrel adapter 164 within the handle portion 102, connecting the styling portion 104 to the barrel adapter, and releasably securing the spring door 250, 300 to the barrel adapter 164. The method includes providing an opening in the barrel adapter 164 for passage of the torsion spring 240 upon release and/or removal of the spring door 250, 300. With the torsion spring 240 positioned between the first and second spring mounts, the method includes biasing one leg 280 of the torsion spring 240 against an inner surface portion of the barrel adapter 164 and biasing the other leg 186 of the torsion spring 240 an inner surface of one of the housing portion 102 and the styling portion 104.

The present disclosure further provides a method of removing and replacing a damaged torsion spring from the hair styling tool or curling iron 100. According to the exemplary method, the fastener 256 is first removed, disconnecting the spring door 250, 300 from one of the handle portion 102 and the barrel adapter 164. Once removed, the spring door can be pivoted downward about the step-shaped end portion 268, 310 received in the cutout 270 and then, optionally, completely removed or separated from the housing 110. The releasing and/or removal of the spring door 250, 300 (and, in turn, the first spring mount 244, 304 integral with the spring door) provides direct access to the torsion spring 240—now only held at least partially within the channel 198 of the barrel adapter 164 by the legs 280, 286 biased against the stand 182 and lever wall 272. The user can then simply, for example, tap the handle portion 102 against a hard surface to displace one of the legs (assuming both legs are still intact with the coiled body of the damaged torsion spring), allowing the torsion spring 240 to fall out of the handle portion. A replacement torsion spring can then be repositioned in the channel 198, with the respective legs 280, 286 biased against the stand 182 and the lever wall 274 of the flipper 130 in its closed position. The door 250, 300 can then be fastened to the barrel adapter 164, which secures the coiled body of the new torsion spring 240 between the first and second spring mounts. In this manner, the damaged torsion spring 240 can be removed from the curling iron 100 and replaced without disassembling the handle portion 102 and/or the styling portion 104.

It will be appreciated that the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A hair styling tool or curling iron comprises:
a handle portion housing a torsion spring; and
a styling portion including a hair engaging member adapted to be biased toward the styling portion by the torsion spring; and
a spring door releasably and/or removably connected directly to the handle portion, the spring door configured to cover and at least partially secure the torsion spring housed within the handle portion,
wherein the torsion spring is not mechanically connected to the handle portion so that releasing and/or removing of the spring door from the handle portion allows for removal and replacement of the torsion spring.

2. The hair styling tool or curling iron of claim 1, including a barrel adapter housed within the handle portion, the styling portion connected to the barrel adapter, and the spring door is releasably connected to the barrel adapter.

3. The hair styling tool or curling iron of claim 2, wherein the hair engaging member is pivotally connected to the barrel adapter.

4. The hair styling tool or curling iron of claim 3, wherein the spring door includes a stop, and the hair engaging member abuts the stop in an open position of the hair engaging member.

5. The hair styling tool or curling iron of claim 2, wherein the barrel adapter includes a body and a stand extended from the body, the spring door is engaged to both the body and the stand.

6. The hair styling tool or curling iron of claim 1, including first and second spring mounts adapted to secure the torsion spring within the handle portion.

7. The hair styling tool or curling iron of claim 6, wherein the first spring mount is provided on the spring door and the second spring mount is provided on one of the handle portion and the styling portion.

8. The hair styling tool or curling iron of claim 7, wherein the second spring mount is provided on the styling portion.

9. The hair styling tool or curling iron of claim 8, wherein the second spring mount is provided on the hair engaging member of the styling portion.

10. The hair styling tool or curling iron of claim 6, wherein the torsion spring is seated between the first and second spring mounts, and further including a barrel adapter housed within the handle portion, the barrel adapter including a body adapted to at least partially receive the torsion spring.

11. The hair styling tool or curling iron of claim 10, wherein with the torsion spring seated between the first and second spring mounts, one leg of the torsion spring is biased against an inner surface portion of the barrel adapter, and the other leg of the torsion spring is biased against an inner surface of one of the handle portion and the styling portion.

12. The hair styling tool or curling iron of claim 11, wherein the inner surface portion includes a notch sized to receive the one leg.

13. A hair styling tool or curling iron comprises:

a handle portion housing a torsion spring; and a styling portion including a hair engaging member adapted to be biased toward the styling portion by the torsion spring; and a spring door releasably and/or removably connected to the handle portion, the spring door configured to cover and at least partially secure the torsion spring within the handle portion, wherein first and second spring mounts secure the torsion spring within the handle portion, the first spring mount provided on the spring door so that releasing and/or removing of the spring door from the handle portion allows for removal and replacement of the torsion spring.

14. The hair styling tool or curling iron of claim 13, wherein the second spring mount is provided on one of the handle portion and the styling portion.

15. The hair styling tool or curling iron of claim 13, including a barrel adapter housed within the handle portion, the styling portion connected to the barrel adapter, and the spring door is releasably connected to the barrel adapter.

16. The hair styling tool or curling iron of claim 15, wherein the barrel adapter includes a body and a stand extended from the body, the spring door is engaged to both the body and the stand.

17. A method of removing a torsion spring from a hair styling tool or curling iron, the hair styling tool or curling iron including:

a handle portion adapted to house the torsion spring, and a styling portion connected to the handle portion and including a hair engaging member adapted to be biased toward the styling portion by the torsion spring, the method comprises:

providing a spring door directly on the handle portion for covering and at least partially securing the torsion spring within the handle portion;

releasing and/or removing the spring door from the handle portion to provide direct access to the torsion spring; and removing the torsion spring from within the handle portion.

18. The method of claim 17, including securing the torsion spring between first and second spring mounts, with one of the first and second spring mounts provided on the spring door.

19. The method of claim 17, including housing a barrel adapter within the handle portion, connecting the styling portion to the barrel adapter, and releasably securing the spring door to the barrel adapter.

20. The method of claim 19, including providing an opening in the barrel adapter for passage of the torsion spring upon release and/or removal of the spring door.

21. The method of claim 19, wherein with the torsion spring positioned between the first and second spring mounts, the method includes biasing one leg of the torsion spring against an inner surface portion of the barrel adapter and biasing the other leg of the torsion spring an inner surface of one of the housing portion and the styling portion.

* * * * *